US006585204B1

(12) United States Patent
Haertzen

(10) Patent No.: US 6,585,204 B1
(45) Date of Patent: Jul. 1, 2003

(54) CONTAINER HOLDER

(76) Inventor: Steven R. Haertzen, 6400 Interlachen Blvd., Edina, MN (US) 55346

( * ) Notice: Subject to any disclaimer, the term of this patent is extended or adjusted under 35 U.S.C. 154(b) by 0 days.

(21) Appl. No.: 10/068,066

(22) Filed: Feb. 5, 2002

Related U.S. Application Data

(60) Provisional application No. 60/266,581, filed on Feb. 5, 2001.

(51) Int. Cl.[7] ..... E06C 7/14
(52) U.S. Cl. ..... 248/211; 182/129
(58) Field of Search ..... 248/301, 210, 248/211, 238, 304; 182/129

(56) References Cited

U.S. PATENT DOCUMENTS

| | | | | | |
|---|---|---|---|---|---|
| 1,024,841 | A | | 4/1912 | Emery | |
| 2,522,658 | A | | 9/1950 | Williams | |
| 2,681,785 | A | * | 6/1954 | Jenny | 248/210 |
| 3,163,389 | A | | 12/1964 | Thornburgh | |
| 3,204,907 | A | | 9/1965 | Tattrie | |
| 3,814,364 | A | * | 6/1974 | Gargaro | 248/210 |
| 3,860,210 | A | | 1/1975 | Berardinelli et al. | |
| 4,004,770 | A | | 1/1977 | Karass | |
| 4,112,541 | A | | 9/1978 | Tetradis | |
| 4,396,174 | A | * | 8/1983 | Continenza et al. | 248/211 |
| 4,491,293 | A | | 1/1985 | Tibbs | |
| 4,580,752 | A | * | 4/1986 | Patrick | 248/210 |
| 5,094,417 | A | | 3/1992 | Creed | |
| 5,226,623 | A | | 7/1993 | Hunt et al. | |
| D356,261 | S | | 3/1995 | Miceli, Jr. | |
| D361,263 | S | | 8/1995 | Carmo et al. | |
| 5,489,078 | A | | 2/1996 | Risley | |
| D394,351 | S | | 5/1998 | Henderson | |
| 5,797,166 | A | | 8/1998 | Wagenheim | |
| D423,348 | S | | 4/2000 | Le Roux | |
| 6,474,607 | B1 | * | 11/2002 | Wilson | 248/211 |

* cited by examiner

*Primary Examiner*—Leslie A. Braun
*Assistant Examiner*—Kofi Schulterbrandt

(57) ABSTRACT

A can holder has oppositely extending hook members adapted to suspend the can from a ladder rung in a forwardly inclined position. The bail of the can is accommodated by a groove open to the top of the holder and located forwardly of the hook members to hold the bail rearwardly from the mouth of the can to facilitate the transfer of material into and out of the can.

17 Claims, 3 Drawing Sheets

CONTAINER HOLDER

CROSS REFERENCE TO RELATED APPLICATION

This application claims the benefit of U.S. Provisional Application Ser. No. 60/266,581 filed Feb. 5, 2001.

FIELD OF THE INVENTION

The invention relates to the field of holders for containers. The holders are container mounted holders releasably attachable to a horizontal extending support, such as a ladder rung and the like.

BACKGROUND OF THE INVENTION

Many different types of paint can holders have been used in the past and in the present. Some are made out of metal, plastic, rubber, rope, twine or cloth and hung from an extension ladder step and attached to the handle of a paint can that may contain a paint, stain, varnish, shellac and the like. These existing devices, whether bought from a supplier or retailer, or made by an individual themselves, hold a paint can to, and from, an extension ladder step. They all have one deficiency in common, namely, it is difficult to get a paint brush or roller into the hanging paint can. The handle must be repeatedly moved or the paint can itself must be moved to allow an easier access to the material inside the paint can.

Emery in U.S. Pat. No. 1,024,841 discloses a bail for a paint bucket inclined slightly toward the back of the bucket for the purpose of holding the bucket slightly forward or toward the person using the bucket to facilitate the insertion and removal of a paint brush from the bucket.

Tattrie in U.S. Pat. No. 3,204,907 discloses a paint can hanger having an arcuate section that curves around the rim of a paint can and a top section that engages the wire handle mounted to opposite sides of the can.

Tibbs in U.S. Pat. No. 4,491,293 discloses a can holder having a handle having a hook engageable with the bail of a can. The length of the handle can be varied to vary the angular relation of the can to the horizontal when the can is suspended by a S-hook.

Hunt el al in U.S. Pat. No. 5,226,623 disclose a paint bucket holder having an ear component that is manually grasped to facilitate movement of a paint bucket between ladder rungs without removing the bail of the bucket from hook.

SUMMARY OF THE INVENTION

The invention comprises a container holder useable to suspend a container from a horizontal support in a forwardly inclined position and hold the bail of the container rearwardly from the open top of the container allowing free and easy access to the material, such as paint, varnish, stain, inside of the container. The holder has a first body portion and a second body portion. The first body portion has a downwardly extending hook member adapted to accommodate a horizontal support member, such as a rung of a ladder. The first body portion has a groove adapted to accommodate a bail pivotally mounted on the upright side wall of a container having an open top. The second body member has an upwardly extending hook member adapted to engage the inwardly directed rim joined to the side wall of the container and the inside surface of the side wall thereby suspending the container in a forwardly inclined position from the horizontal support and holding the bail rearwardly from the open top of the container.

DESCRIPTION OF PREFERRED EMBODIMENT

Figure 1:
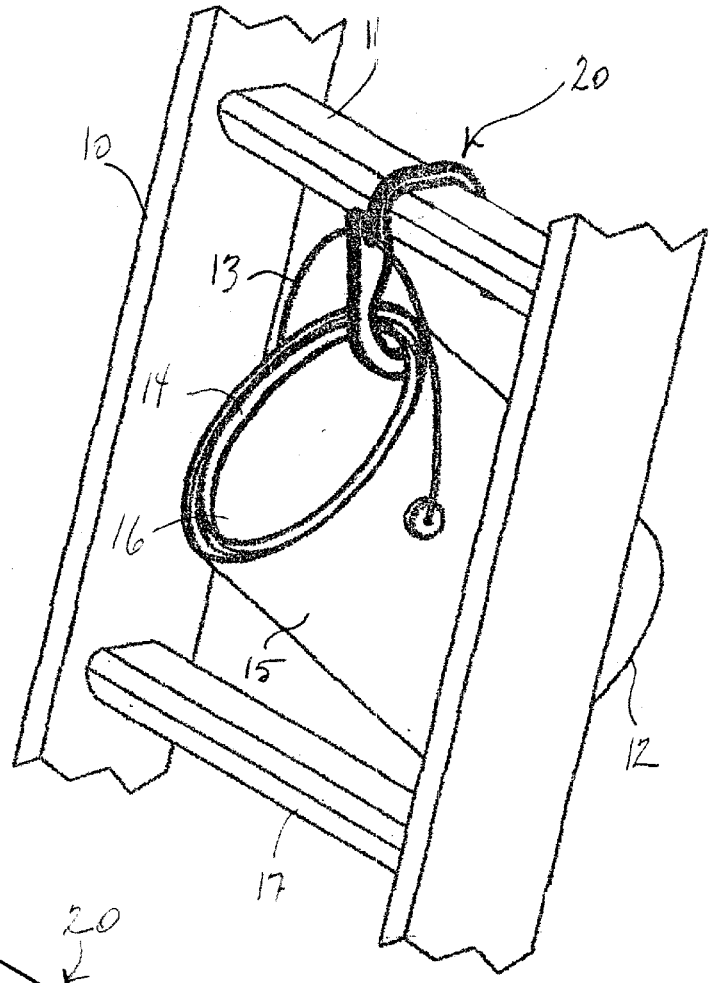
FIG. 1 is a front perspective view of a container holder of the invention mounted to a material container and suspended from a rung of a ladder.
Figure 2:
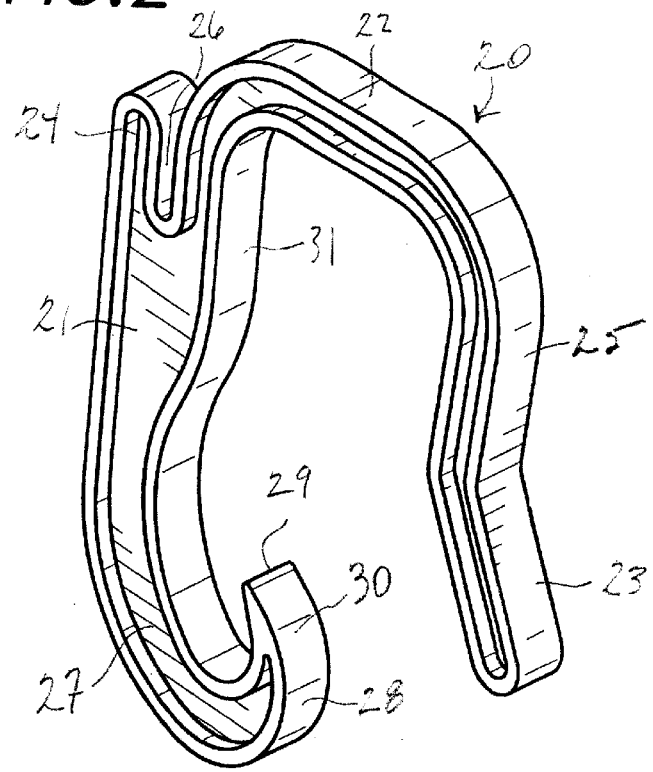
FIG. 2 is an enlarged front perspective view of a container holder of FIG. 1.
Figure 3:
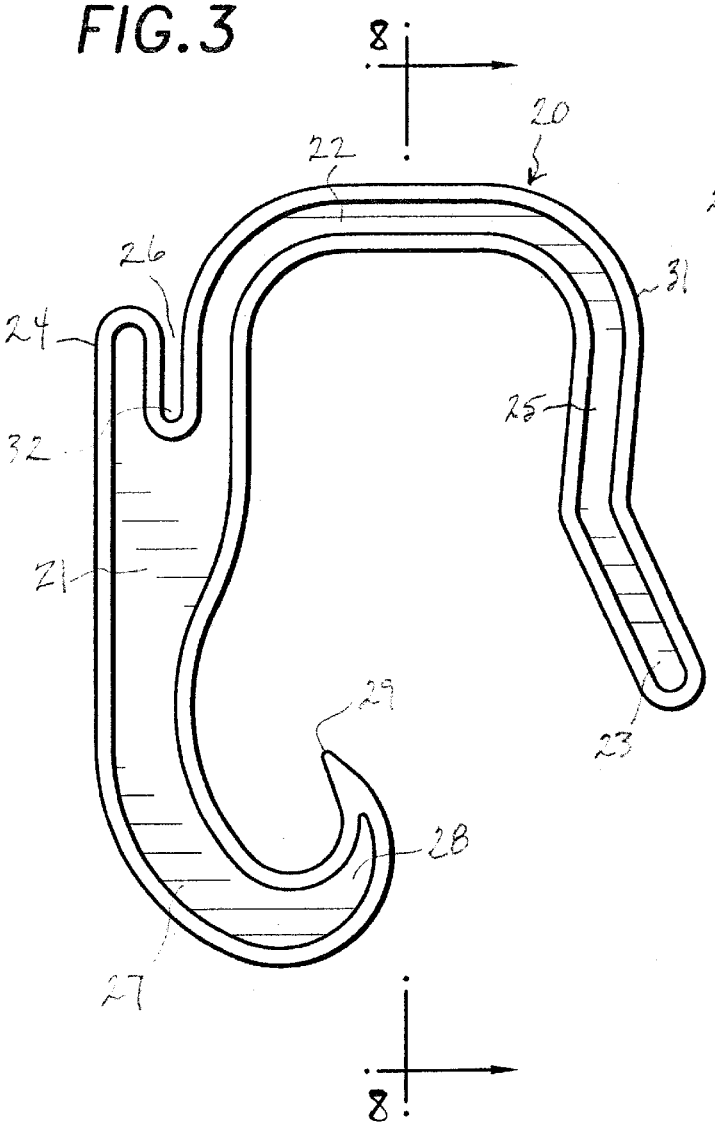
FIG. 3 is a front elevational view of FIG. 2.
Figure 4:
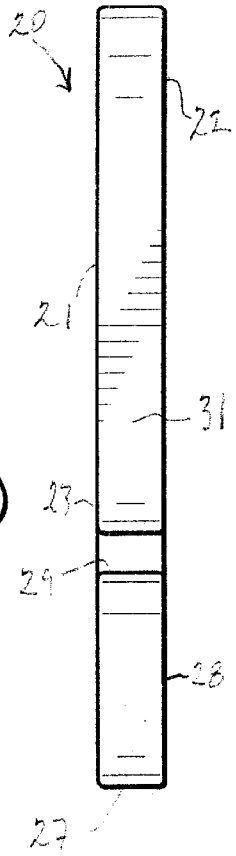
FIG. 4 is a side elevational view of the right side of FIG. 2.
Figure 5:
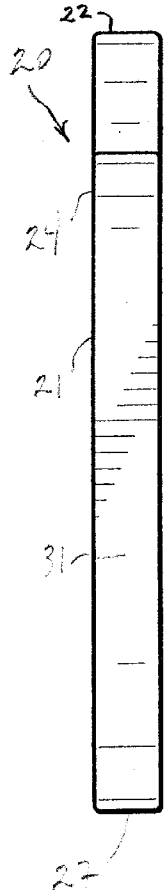
FIG. 5 is a side elevational view of the left side of FIG. 2.
Figure 6:
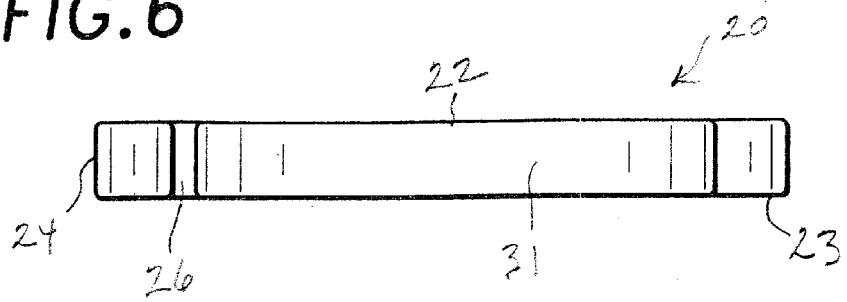
FIG. 6 is a top plan view of FIG. 2.
Figure 7:
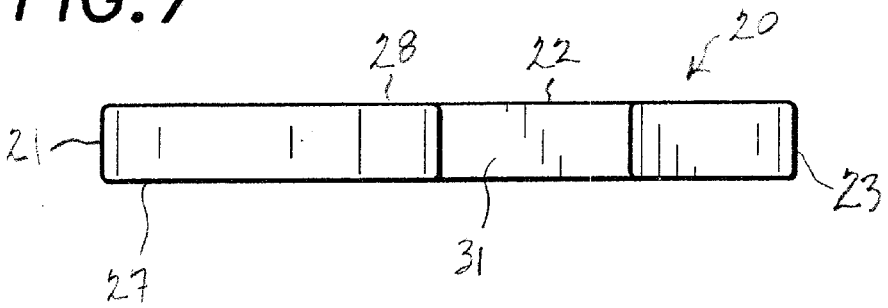
FIG. 7 is a bottom plan view of FIG. 2.

A container holder, indicated at 20, in FIGS. 1 to 7, is a one-piece tool useable to suspend a container 12 from a horizontal cross member, such as a rung 11 of an extension ladder 12. Container 12 is a conventional one-gallon container having a bail 13 rotatably mounted on an upright cylindrical wall 15. An inwardly directed annular rim 14 joined to the top of wall 15 surrounds the open end 16 of container 12. Container 12 is used to contain material, such as paint, stain, varnish, shellac, liquid cleansers and the like, to be applied to a surface. Container 12 can also be an empty container used in gathering or collecting fruit and other solid or liquid items and materials. Holder 20 is useful on any size extension ladder. It can be manufactured out of molded plastic, metal, fiberglass, wood or like relatively rigid material. It can be used by anyone who has to paint, be it a homeowner or a professional painter, or anyone who needs to gather or collect items. Holder 20 is mounted on container 12 to forwardly inclined the open end 16 of container 12 and hold bail 13 toward the rearwardly edge of container 12, as shown in FIG. 1, thereby increasing the accessibility to the material inside of container 12 or facilitating the placement of material into container 12.

Figure 8:
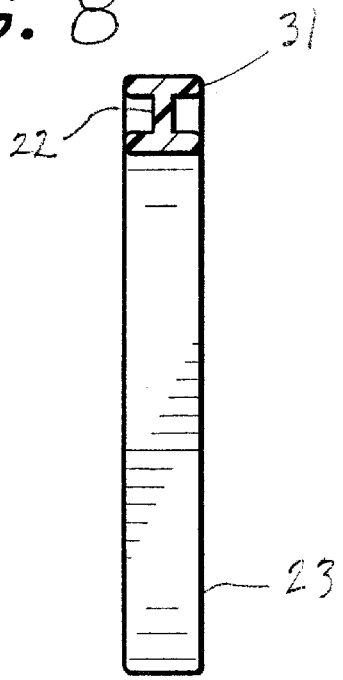
FIG. 8 is a sectional view taken along line 8—8 of FIG. 3.

Holder 20 has a generally upright body portion 21 having a uniform width. Body 21 has a height approximately twice its width. Preferably, holder 21 is approximately 6½ inches tall at the longest measurement measuring from outside edge to outside edge and approximately 3½ inches wide at the widest of measurements from outside edge to outside edge. The approximate thickness of body 21 is ⅜ inches, and the approximate width thereof is ¼ inch. Body 21 can have other height, length, thickness, and width dimensions. Body 21 has a top portion 24 having a rearwardly extending head 22. Body 21 has an I-beam shaped cross section, as shown in FIG. 8. A rib 31 extending around the periphery of body 21 forms the outer sides of body 21 and functions to strengthen body 21. The top portion 24 of body 21 has a head 22 having a downwardly extended middle portion or arm 25 joined to an outwardly and rearwardly extending lip 23. Head 22 is a downwardly extending inverted L-shaped hook member for pendently suspending container 12 from rung 11. Head 22 can also function as a carrying handle to facilitate gripping and handling of holder 20 when moving container from one location to another location, such as from rung 11 to an adjacent rung 17. Arm 25 and lip 23 function to guide holder 20 when positioning container 12 on rung 11. The outer end of lip 23 can be tapered to a generally flat edge for use in opening container 12.

Top portion 24 of body 21 has a relatively narrow upright linear groove 26 open to the top of top portion 24. Groove 26 accommodates the wire bail 13 of material container 12. The width of groove 26 is slightly wider than the circumference of bail 13 so as to have a sliding fit relation with bail 13. Bail 13 is located in the bottom 32 of groove 26 when holder 20 is mounted on container 12. Groove 26 has a depth sufficient to minimize slippage of bail 13 from groove 26. Preferably, groove 26 is a linear shaped groove having a depth of ¾ inches and a width of 3/16 inches to minimize the transverse movement of bail 13 in groove 26. Groove 26 can have other shapes, such as an inwardly tapered shape. The distance between the bottom 32 of groove 26 and the end 29 of hook 28 is substantially the same as the distance between the top of side wall 15 and the middle portion of bail 13 when the middle portion of bail 13 is vertically aligned with the top of side wall 15.

Body 21 has a lower portion 27 having an upwardly and inwardly directed hook 28. Hook 28 extends upwardly and inwardly opposite from and inside the rearward and downward extension of head 22. The outer portion of hook 28 tapers to a generally flat transverse end 29 located downwardly and rearwardly from groove 26. End 29 engages the bottom surface of rim 14 and outer surface 30 of hook 28 engages the inner surface of container wall 15 to support container 12 in a forwardly inclined position relative to rung 11. End 29 is inwardly inclined tapering toward groove 26. End 29 has an inward incline whereby the degree of tilt of container 12, shown in FIG. 1, is approximately 30° thereby opening up the open end 16 of container and providing increased exposure to the material inside of container 12. The angle of the inward inclination of end 29 can be varied to increase or decrease the degree of forward tilt of container 12 as desired. End 29 can have an outer surface with a curved shape complementary to the curve of cylindrical wall 15 of container 12. End 29 can be wider than the width of body 21 to further support container 12. End 29 is laterally and downwardly spaced from the outer end of lip 23 to accommodate rung 11.

In use, bail 13 of an open top container 12 is inserted into groove 26 of body 21. While maintaining bail 13 in groove 26, bail 13 is rotated rearwardly toward cylindrical wall 15 of container 12 to position the lower portion 27 of body 21 in the interior of container 12. Body 21 is then rotated forwardly relative to bail 13 to move outer surface 30 of upwardly extending hook 28 into engagement with the inside surface of cylindrical wall 15 and move end 29 into engagement with the bottom surface of rim 14 projecting inwardly from the top of wall 15. When holder 20 is moved upwardly the rearwardly side of container 12 is moved upwardly thereby forwardly inclining open end 16 of container 12. Head 22 is then positioned on a horizontal support member, such as a rung 11 of a ladder 10 to suspend container from rung 11 in a forwardly inclined position above rung 17, as shown in FIG. 1. Bail 13 is held rearwardly from open end 16 of container 12 whereby bail 13 does not interfere with the transfer of material into and out of container 12.

The present disclosure is a preferred embodiment of the container holder. It is understood that the container holder is not to be limited to the specific materials, constructions and arrangements shown and described. It is understood that changes in parts, materials, arrangement and locations of structures may be made without departing from the invention.

What is claimed is:

1. A holder for suspending a container from a support member, the container having an upright side wall, a bail pivotally mounted on the side wall, an open end, and an inwardly directed rim joined to the side wall, comprising: a body having an I-beam shaped cross section, the body having a first body portion and a second body portion, the first body portion having a downwardly extending hook member adapted to accommodate a horizontally extending support member, the first body having groove means adapted to accommodate the bail of a container pivotally mounted on the side wall of the container, the second body member having an upwardly extending hook member adapted to engage the rim and sidewall of the container thereby suspending the container in a forwardly inclined position from the horizontally extending support and holding the bail rearwardly from the open end of the container.

2. The holder of claim 1 wherein: the downwardly extending hook member has an outwardly directed lip.

3. The holder of claim 1 wherein: the upwardly extending hook member has an inwardly tapered end.

4. The holder of claim 3 wherein: the groove means has a bottom portion, the distance between the bottom portion and the end of the upwardly extending hook member is substantially the same as the distance between a middle portion of the bail and a top portion of the side wall of the container when the middle portion of the bail and the top portion of the side wall are in vertical alignment.

5. The holder of claim 1 wherein: the downwardly extending hook member is laterally spaced from the upwardly extending hook member for accommodating the horizontally extending support member.

6. The holder of claim 1 wherein: the groove means is a generally upright linear groove extending into the first body portion forwardly of the upwardly extending hook member.

7. The holder of claim 1 including: rib means extending around the periphery of the body.

8. A holder for suspending a container from a support member, the container having an upright side wall, a bail pivotally mounted on the side wall, an open end, and an inwardly directed rim joined to the side wall, comprising: a body having a first body portion and a second body portion, the first body portion having a downwardly extending hook member adapted to accommodate a horizontally extending support member, the first body having groove means adapted to accommodate the bail of a container pivotally mounted on the side wall of the container, the second body member having an upwardly extending hook member adapted to engage the rim and sidewall of the container thereby suspending the container in a forwardly inclined position from the horizontally extending support and holding the bail rearwardly from the open end of the container, the downwardly extending hook member having an end upwardly and rearwardly spaced from the upwardly extending hook member.

9. A holder for suspending a container from a support member, the container having an upright side wall, a bail pivotally mounted on the side wall, an open end, and an inwardly directed rim joined to the side wall, comprising: a body having a first body portion and a second body portion, the first body portion having a downwardly extending hook member adapted to accommodate a horizontally extending support member, the first body having groove means adapted to accommodate the bail of a container pivotally mounted on the side wall of the container, the second body member having an upwardly extending hook member adapted to engage the rim and sidewall of the container thereby suspending the container in a forwardly inclined position from the horizontally extending support and holding the bail rearwardly from the open end of the container, the body being a one-piece plastic molded member having a uniform width.

10. A holder for suspending a container from a rung of a ladder comprising: a one-piece body having a top body portion and a bottom body portion, the top body portion having an upright groove for accommodating a bail rotatably mounted to a container, the top body portion having a downwardly extending hook member for accommodating a rung of a ladder, the bottom body portion having an upwardly extending hook member engageable with the container to suspend the container in a forwardly inclined position from the rung and hold the bail in a rearwardly position relative to the container.

11. The holder of claim 10 wherein: the body has an I-beam shaped cross section.

12. The holder of claim 10 wherein: the downwardly extending hook member has an outwardly directed lip.

13. The holder of claim 10 wherein: the upwardly extending hook member has an inwardly tapered end.

14. The holder of claim 10 wherein: the groove has a bottom portion, the distance between the bottom portion of the groove and the end of the upwardly extending hook member is substantially the same as the distance between a middle portion of the bail and a top portion of a side wall of the container when the middle portion of the bail and the top portion of the side wall are in vertical alignment.

15. The holder of claim 10 wherein: the groove extends longitudinally into the top body portion forwardly of the upwardly extending hook member.

16. The holder of claim 10 including: rib means extending around the periphery of the body.

17. The holder of claim 10 wherein: the downwardly extending hook member has an end upwardly and rearwardly spaced from the upwardly extending hook member.

* * * * *